United States Patent [19]

Topic

[11] 4,051,828

[45] Oct. 4, 1977

[54] IGNITION SYSTEM FOR USE WITH INTERNAL COMBUSTION ENGINES

[76] Inventor: Eugene Frank Topic, Drugs. St., Glamorgan Shop. Center, Calgary, Alberta, Canada, T3E 3K1

[21] Appl. No.: 635,571

[22] Filed: Dec. 29, 1975

[51] Int. Cl.[2] ..... F02P 1/00

[52] U.S. Cl. ..... 123/148 E; 315/209 T

[58] Field of Search ..... 123/148 E, 148 CB; 315/209 T

[56] References Cited

U.S. PATENT DOCUMENTS

| | | | |
|---|---|---|---|
| 3,368,540 | 2/1968 | Ault | 123/148 E |
| 3,512,042 | 5/1970 | Malavasi | 123/148 E |
| 3,671,805 | 6/1972 | Schuette | 123/148 E |
| 3,780,717 | 12/1973 | Rakitch | 123/148 E |
| 3,808,513 | 4/1974 | Canup | 123/148 E |
| 3,913,550 | 10/1975 | Canup | 123/148 E |
| 3,973,545 | 8/1976 | Fischman | 123/148 E |

*Primary Examiner*—Carroll B. Dority, Jr.
*Assistant Examiner*—Ronald B. Cox
*Attorney, Agent, or Firm*—Shlesinger, Arkwright, Garvey & Dinsmore

[57] ABSTRACT

The sub-ultrasonic ionization ignition system "PULSAR" changes the present characteristics of combustion in internal combustion engines.

1 Claim, 1 Drawing Figure

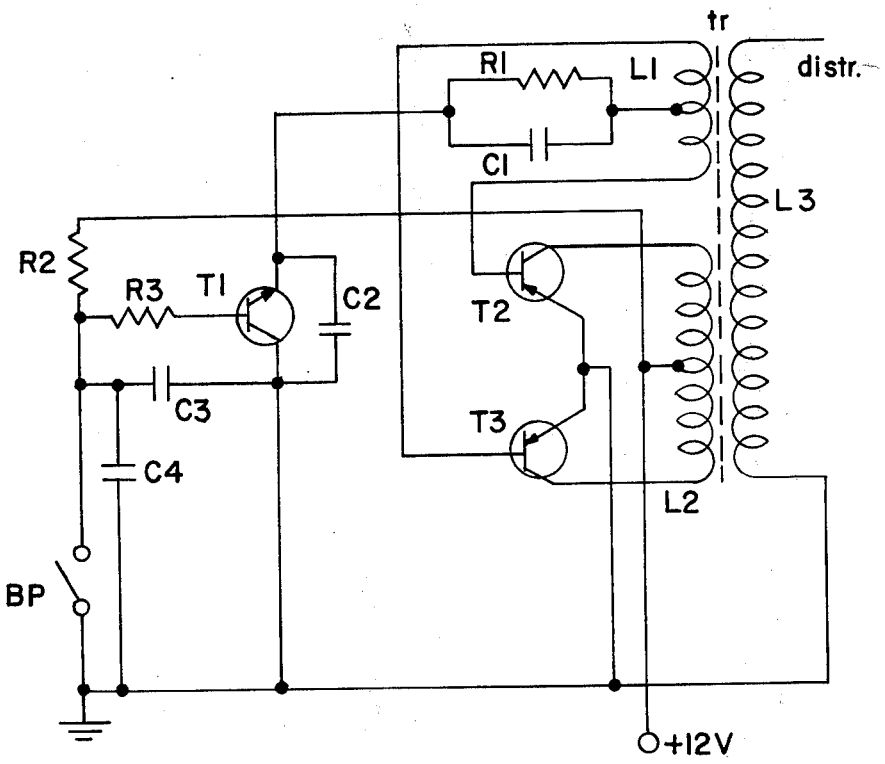
tr
R1
L1
distr.
C1
L3
R2
R3
T1
C2
T2
C3
T3
C4
L2
BP
+12V

IGNITION SYSTEM FOR USE WITH INTERNAL COMBUSTION ENGINES

This type of combustion is known as "turbulent", which the automotive industry has been trying to achieve for years. Turbulent combustion in the past has been achieved only in diesel engines.

The benefits of this system are attributed to the development of special method of switching circuits which permits an instant build up of the converter energy to a specific quality.

This system is simpler and more reliable than other systems and can be considered as a new approach to improving efficiency, economy and reducing noxious emissions so that there is no need for expensive and troublesome exhaust emission controls.

The present invention pertains to an ignition system for use with internal combustion engines.

DESCRIPTION OF THE NEW SYSTEM

It has been proven that shortcomings of ignition systems can be overcome by incorporating a sub-ultrasonic frequency high voltage converter. Such a converter, when actuated by suitable timing means, synchronised with the engine provides high voltage ionisation between the points of the engine sparkplugs. This leads to improved fuel economy, greater power output from the engine and substantially lower levels of noxious emissions. In my invention is the newly developed switching circuit, which permits an instant energy build up without breaking down the magnetic charge of the transformer core. This permits the full high voltage energy to rise fast enough even at the peak rotation of the engine. This fact is completely missing in the prior art.

To the best of my knowledge no one has yet designed a subultrasonic frequency ionisation ignition system which changes the present type of combustion to the turbulent type which I have achieved.

BRIEF DESCRIPTION OF THE DRAWING

FIG. 1 shows a circuit diagram of the invention.

DESCRIPTION OF DRAWING

BP — Breaker points
C1 — Condenser
C2 — Condenser
C3 — Condenser
C4 — Condenser
R1 — Resistor
R2 — Resistor
R3 — Resistor
T1 — Switching silicon power transistor
T2 — Converter germanium power transistor
T3 — Converter germanium power transistor
L1 — Feedback primary coil
L2 — Power primary coil
L3 — Power secondary coil
tr — Transformer
Distr. — Distributor rotor +12V — Positive terminal of the vehicle battery

THE SYSTEM WORKS AS FOLLOWS:

The switching transistor T1 is operated by the break points BP. The converter is turned on when the feedback circuit is "connected" to the ground through the switching transistor T1.

When the base of the switching transistor is "grounded," the converter is turned off since the emitter and collector are "disconnected."

When 12 Volts D.C. positive is applied to the base of the switching transistor T1 the emitter and collector are "closed" or "connected", allowing current flow.

This way powertransistors T2 and T3 start oscillating and on the secondary coil of the transformer the high voltage energy is generated. This energy is delivered into the distributor rotor and a "shower" of ionisation is delivered to the proper sparkplug.

The present invention provides energy for sparkplugs in the sub-ultrasonic range, which is important in achieving the desired results. Prototypes of this device have produced substantial improvements in fuel economy and significant reductions of noxious emissions by achieving more complete combustion, called the automotive industry "turbulent" combustion.

The present invention uses a simplified D.C. to A.C. power converter and also uses a switching transistor operated by the conventional breaker points to govern the operation of the converter. The converter is turned on when the feedback circuit is connected to the ground, and turned off when the feedback circuit is disconnected from the ground, through the switching transistor.

If the positive terminal of the 12V D.C. vehicle power source (battery) is connected to the base of the switching transistor, the emitter and collector are "closed" or "connected" and the converter is functioning at full output. When the positive power is disconnected by the switching transistor the converter is idling.

This device produces A.C. sinusoidal pulses in the range of 10,000 to 15,000 cycles per second, which achieves ionisation resulting in a "turbulent" type of combustion. The "shower of sparks" is sustained for the desired time duration during the power stroke by means of a conventional breaker points, which when open cause the switching transistor to operate the converter. Distribution of the pulses to the appropriate engine cylinder is accomplished by using the conventional distributor and spark plugs. The significant achievement of this ignition device, is "turbulent" combustion. Hydrocarbons swirl and burn in a very short time period. With the conventional ignition devices where a spark ignites the flame front (or wave) and expands gradually through the mixture along the flame front line; the combustion is incomplete resulting in rich noxious emissions and poor efficiency. Furthermore, turbulent combustion produces about 40% more $CO_2$ and 30% more $0_3$ (ozone) which in massive use of this ignition system may contribute to the better environment and enrich the protective 03 (ozone) stratospheric layer, presently vanishing by evaporated hudrocarbons.

I claim:

1. An ignition system for an internal combustion engine for improving the efficiency and reducing noxious emissions thereof by causing turbulent combustion by means of an electrical ignition impulse across a spark gap, said electrical ignition impulse having a sinusoidal waveform and a frequency of about 10,000 to 15,000 Hertz, said ignition system comprising:

a. a transformer having a power secondary coil connected to said spark gap, a power primary coil, and a feedback primary coil, said primary coils each having center taps, b. a transistor power amplifier connecting said power primary coil and said feedback coil, c. a switching transistor connected to said center tap of said feedback primary coil, d. a DC bias voltage connected to said center of said power primary coil, and e. breaker points connecting said switching transistor to ground.

* * * * *